US006077070A

United States Patent [19]

Doucet et al.

[11] Patent Number: 6,077,070

[45] **Date of Patent: *Jun. 20, 2000**

[54] CHILD RESISTANT LIGHTER

[75] Inventors: Michel Doucet, Bains sur Oust, France; Enrique Amoros Nollas, Reus, Spain; Rene Frigiere, Allaire, France

[73] Assignee: BIC Corporation, Milford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/922,039

[22] Filed: Sep. 2, 1997

[51] Int. Cl.[7] ..... F23D 11/36

[52] U.S. Cl. ..... 431/153; 431/255

[58] Field of Search ..... 431/153, 277, 431/255

[56] References Cited

U.S. PATENT DOCUMENTS

| | | | |
|---|---|---|---|
| 3,169,672 | 2/1965 | Soffer et al. | 222/153 |
| 3,898,031 | 8/1975 | Rusakowicz | 431/130 |
| 4,424,920 | 1/1984 | Tada | 222/402.11 |
| 4,752,020 | 6/1988 | Grueter et al. | 222/402.15 |
| 4,784,602 | 11/1988 | Nitta | 431/153 |
| 4,904,180 | 2/1990 | Nitta | 431/153 |
| 4,962,869 | 10/1990 | Gross et al. | 222/153 |
| 5,035,608 | 7/1991 | Parren | 431/153 |
| 5,145,358 | 9/1992 | Shike et al. | 431/153 |
| 5,228,849 | 7/1993 | Frigiere | 431/255 |
| 5,262,697 | 11/1993 | Meury | 310/399 |
| 5,409,372 | 4/1995 | Nobuo | 431/153 |
| 5,435,719 | 7/1995 | McDonough et al. | 431/153 |
| 5,451,159 | 9/1995 | Kim | 431/277 |
| 5,462,432 | 10/1995 | Kim | 431/153 |
| 5,558,514 | 9/1996 | Ansquer | 431/153 |
| 5,584,682 | 12/1996 | McDonough et al. | 431/153 |
| 5,636,979 | 6/1997 | McDonough et al. | 431/153 |
| 5,788,476 | 8/1998 | Sher | 431/153 |

FOREIGN PATENT DOCUMENTS 2295359 12/1973 France .

*Primary Examiner*—Carl D. Price
*Attorney, Agent, or Firm*—Pennie & Edmonds LLP

[57] ABSTRACT

A lighter of the disposable type, ignition of which requires depression of an actuator that is resistant to the manipulations of unintended users. The lighter is normally maintained in a position that prevents depression of the actuator through the incorporation of a mechanism that increases the difficulty of operation. The safety mechanism requires displacement in two directions in order to allow full depression of the actuator and activation of an ignition means. When the mechanism is so displaced through the application of force by a user, it cannot remain displaced without continuous application of such force and will return to the normal, blocking, position when the force is removed.

11 Claims, 12 Drawing Sheets

CHILD RESISTANT LIGHTER

BACKGROUND OF THE INVENTION

1. Technical Field

The present invention relates to a lighter employing an ignition system which presents increased difficulty of operation by unintended users and, more particularly, a piezoelectric lighter with such system.

2. Discussion of the Related Art

Disposable gas lighters are available in a variety of forms. One common element of disposable lighters, though, is an actuator pad or lever used to initiate the flow of fuel. An actuator pad is operated in conjunction with a spark producing mechanism so that the flow of fuel is ignited soon after it commences. For example, lighters employing conventional spark wheels require a user to rotate a toothed spark wheel against a flint in order to generate a spark. The user then depresses the actuator pad, releasing gas and producing a flame.

Another means of ignition for disposable lighters employs a piezoelectric mechanism. In this type of ignition mechanism, a piezoelectric element, such as a crystal, is struck by a hammer in order to produce an electric spark. The spark is conducted to the opening of the fuel valve to ignite the gaseous fuel. The actuator pad, upon forced depression by a user, commences both the flow of the fuel and the ignition process. An example of such a piezoelectric ignition mechanism is disclosed in U.S. Pat. No. 5,262,697, entitled "Piezoelectric Mechanism for Gas Lighters."

As with spark wheel ignition mechanisms, measures have been introduced to prevent activation of piezoelectric mechanisms by unintended users such as children 5 years old and younger. One typical method employed is to incorporate a latch member under the actuator pad that inhibits depression of the actuator pad. Examples of such mechanisms are shown in U.S. Pat. Nos. 5,435,719, 5,584,682, and 5,636,979.

There remains, however, a need in the art for mechanisms which increase the difficulty of operation by unintended users and at the same time are user-friendly for the intended user.

SUMMARY OF THE INVENTION

It is thus an object of this invention to provide a lighter that is easily operated by an adult, but which is resistant to operation by young children.

This and other objectives are met by a piezoelectric lighter with an elongated body defining a fuel reservoir and including a valve for dispensing such fuel. The lighter further includes an actuator that, upon depression, activates the ignition system, which requires the release of fuel from the reservoir and activation of a piezoelectric mechanism which makes a spark. Depression of the actuator is normally barred, however, by a blocking mechanism. Displacement of the blocking mechanism in the specified manner allows the actuator to be depressed. The blocking mechanism, which is incorporated into the actuator, is displaced through pressure by a user. Upon removal of the displacing force the blocking mechanism returns to its initial blocked position, once again preventing the actuator from being depressed sufficiently to activate the ignition system.

BRIEF DESCRIPTION OF THE DRAWINGS

These and other objects, features, and advantages of the invention will become more readily apparent from the following detailed description which should be read in conjunction with the accompanying drawings, in which like elements are labeled similarly, and in which.

DETAILED DESCRIPTION OF THE INVENTION

Figure 1:
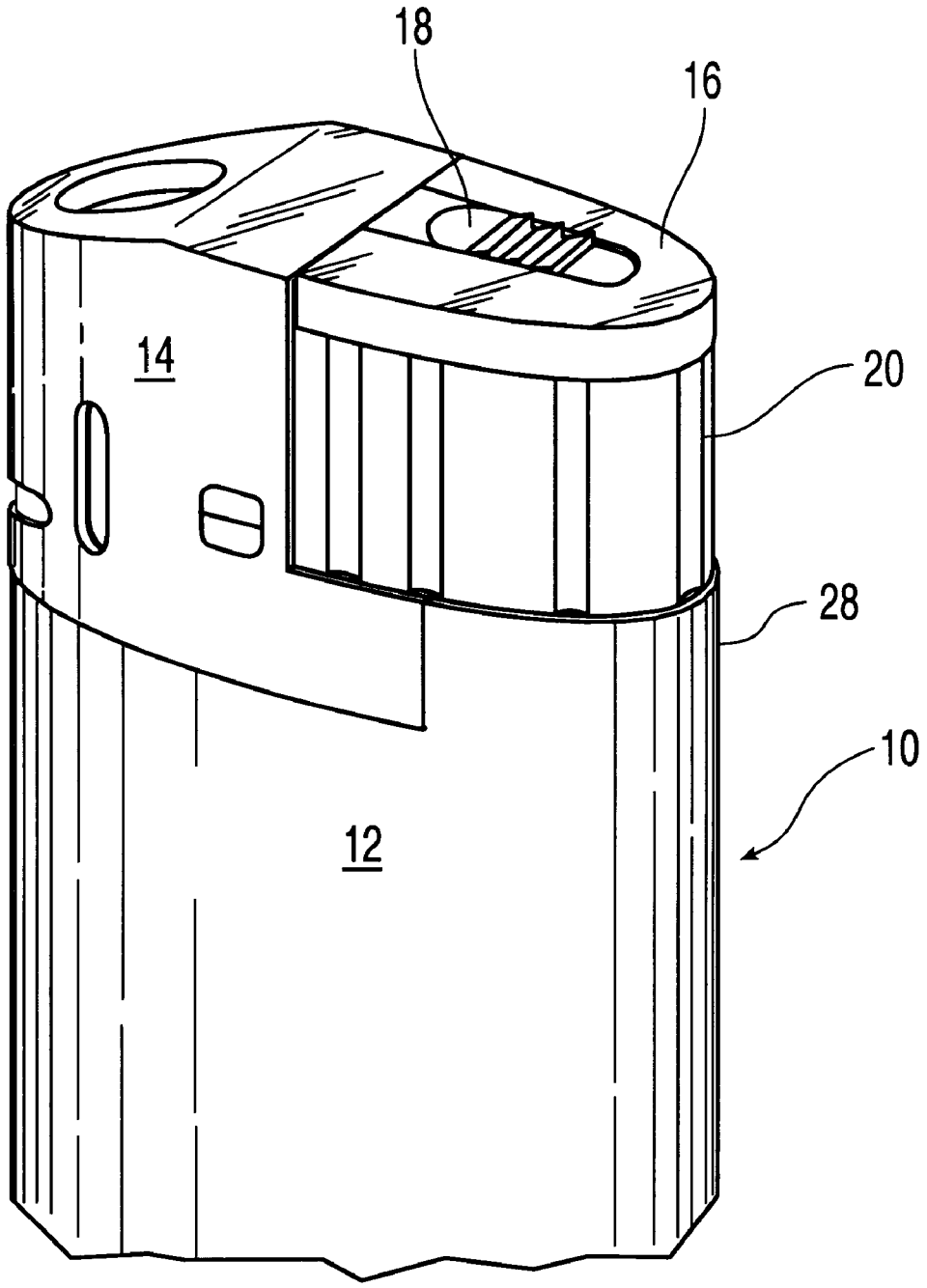
FIG. 1 is a partial perspective view of one embodiment of a lighter according to the present invention in its idle configuration.

Referring to FIG. 1, a partial cross-sectional view of a first illustrative embodiment of the present invention is provided, in which lighter 10 is comprised of body portion 12, wind guard 14, and depressible valve actuator 16. Actuator 16 includes slide member 18. Slide member 18 is substantially encircled at the top surface of lighter 10 by actuator 16, but vertical extension 20 of slide member 18 projects downward when at rest to form an extension of rear wall 28 of lighter 10. Slide member 18 is biased toward its normal rearward position, as shown in FIG. 2, by slide spring 30.

Figure 2:
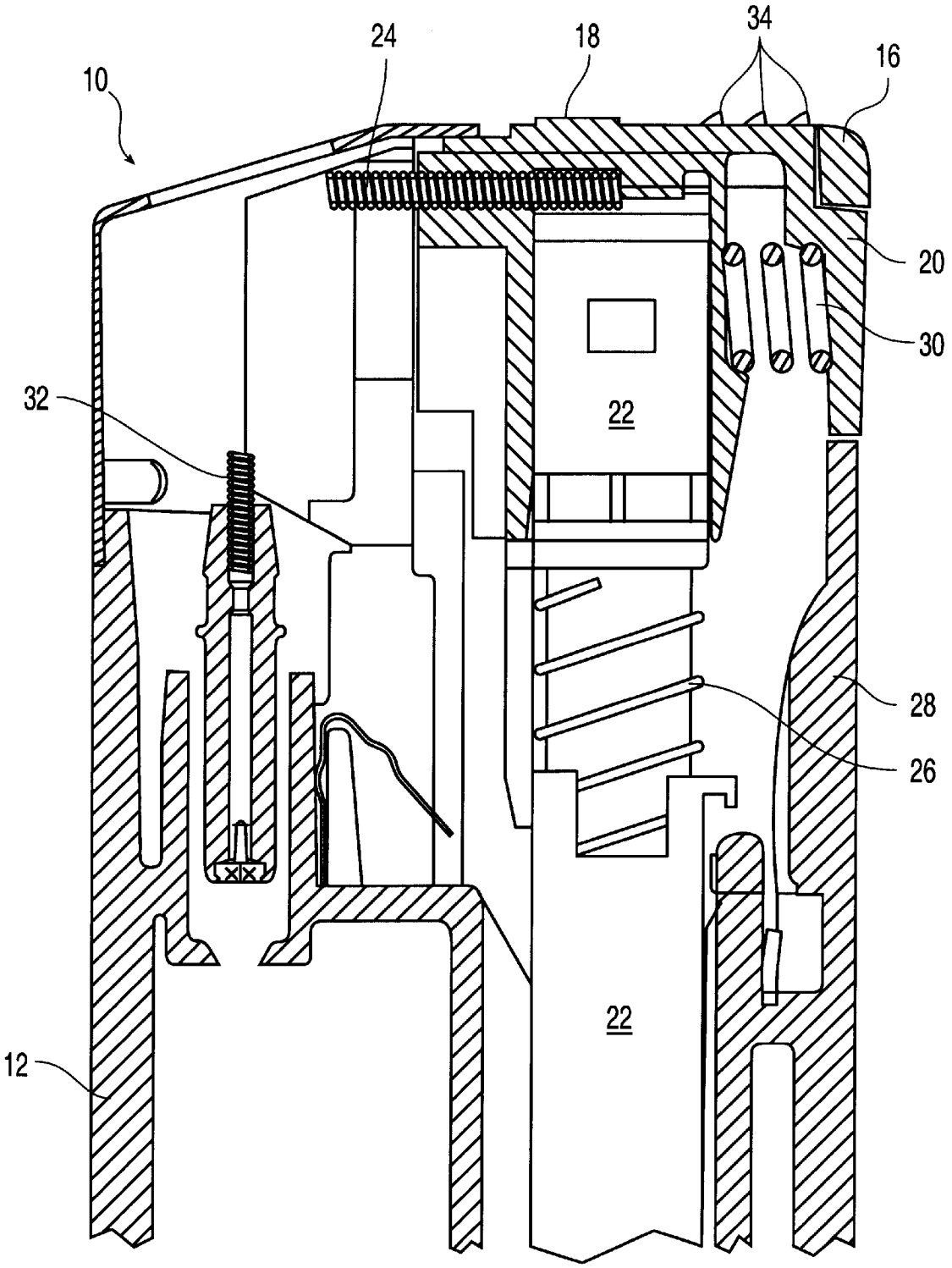
FIG. 2 is a partial cross-sectional view of the lighter depicted in FIG. 1.

With reference now to FIG. 2, further details of the ignition system and safety feature of lighter 10 are depicted. An upper portion of piezoelectric ignition mechanism 22 is connected to actuator 16. Spark conductor 24 is electrically connected to ignition mechanism 22 in a known manner. A lower portion of ignition mechanism 22 is connected to body portion 12. Depression of actuator 16 commences the flow of fuel through fuel nozzle 32, to be ignited by a spark conducted by spark conductor 24.

Coil spring 26 is positioned between the upper and lower portions of ignition mechanism 22. Spring 26 imparts an upward bias to resist depression of actuator 16 and compression of ignition mechanism 22. Spring 26 is illustrated as a coil spring, but any other suitable biasing element may be employed, such as a separate leaf spring or integrally molded plastic spring.

Figure 3:
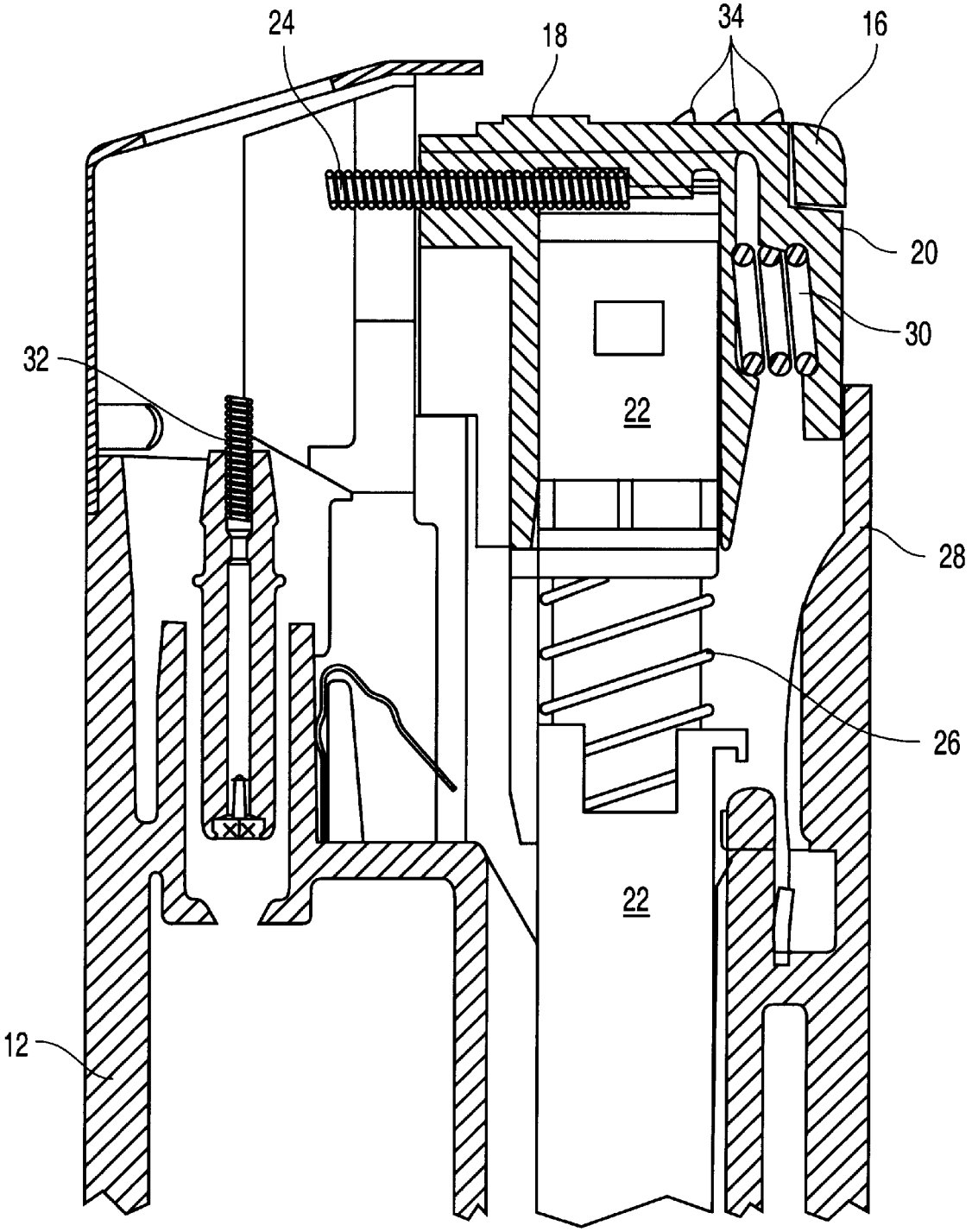
FIG. 3 is a partial cross-sectional view of the lighter depicted in FIG. 1, in an ignition position.

In its normal position, depicted in FIGS. 1 and 2, actuator 16 cannot be depressed to activate the ignition system due to the obstructing alignment of vertical extension 20 with rear wall 28. To enable ignition, the user must apply a horizontal force upon slide member 18 in order to inwardly displace vertical extension 20 from alignment with rear wall 28. After slide member 18 is displaced inwardly, actuator 16 may then be depressed, as depicted in FIG. 3, thus compressing ignition mechanism 22 and causing ignition. Depression of actuator 16 also serves to bring spark conductor 24 into proximity with fuel nozzle 32, thus facilitating generation of an ignition spark. In this embodiment, ridges 34 are incorporated into slide member 18 to assist the user in applying sufficient inward force to overcome the biasing effect of slide spring 30.

After lighter 10 has been used, spring 26 assists in forcing actuator 16 to return to its normal elevation and slide spring 30 forces slide member 18 to its normal rearward position.

Figure 4:
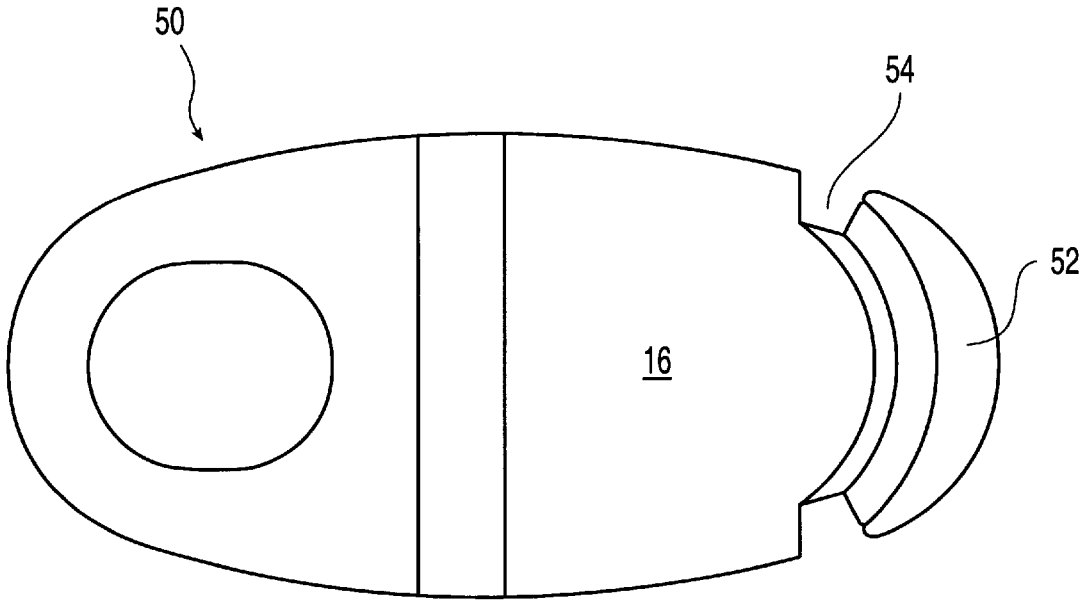
FIG. 4 is a top view of a second embodiment of the present invention in an idle configuration.
Figure 5:
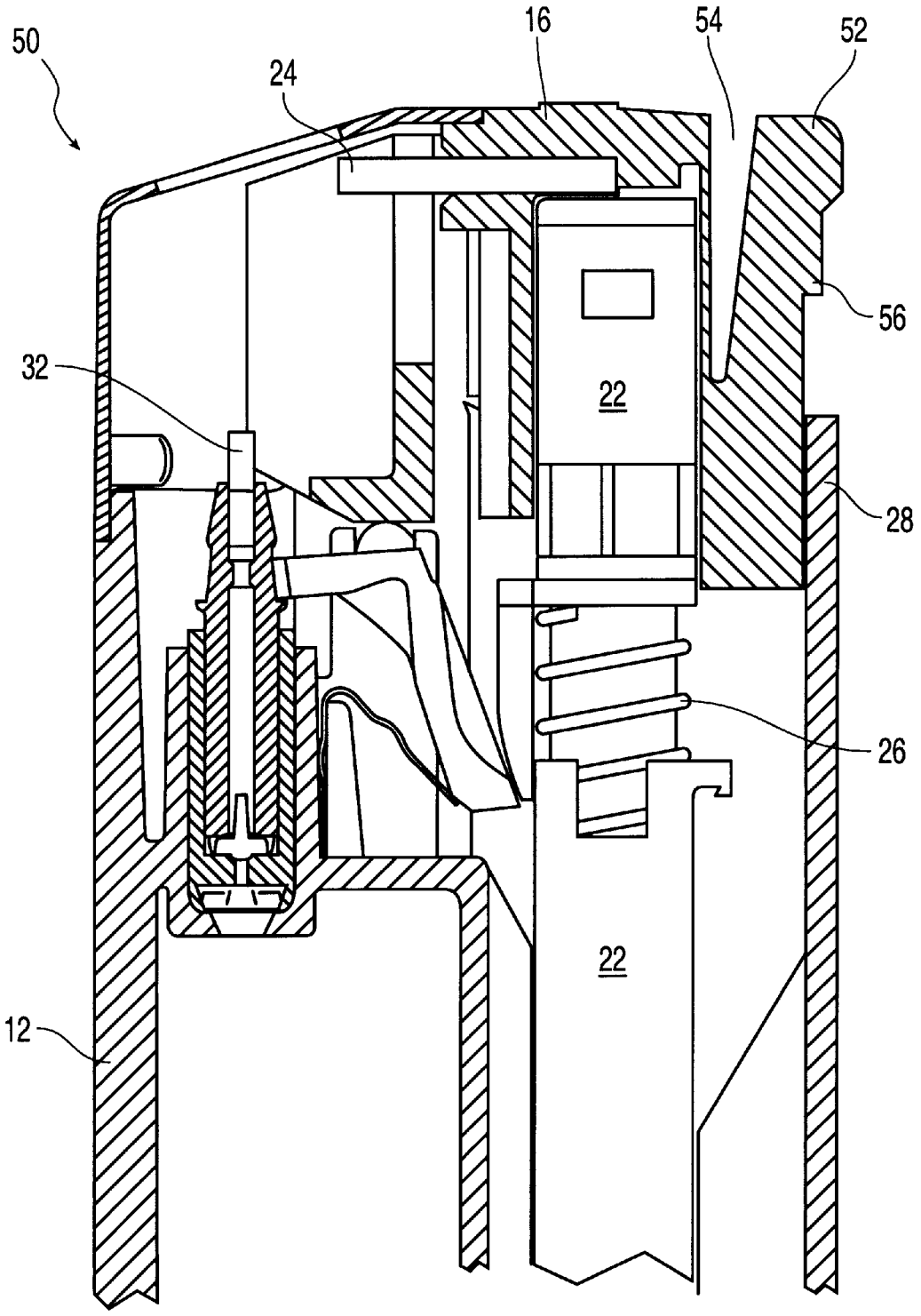
FIG. 5 is a partial cross-sectional view of the lighter depicted in FIG. 4.

Another embodiment of the invention is depicted in FIGS. 4–8. With reference now to FIGS. 4 and 5, lighter 50 is shown in its normal position. Actuator 16 includes tab 52, separated from the main portion of actuator 16 by gap 54. Tab 52 includes one or more steps 56 and is connected to actuator 16 at the lower end of actuator 16, thus allowing the tab to operate as a lever. The lower portion of actuator 16, where tab 52 is joined, must be of sufficient strength and dimension to withstand repeated pivotal displacements of tab 52.

An attempt to operate lighter 50 as it appears in FIGS. 4 and 5, without displacing tab 52 as described below, results in the configuration depicted in FIG. 6. Step 56 catches upon rear wall 28 of body 12 of lighter 50, thus preventing activation of the ignition system. Alternatively, lighter 50 may be constructed such that step 56 catches upon a portion (not shown) of lighter 50 internal and integral to body 12 when actuator 16 is depressed from the normal position.

Figure 6:
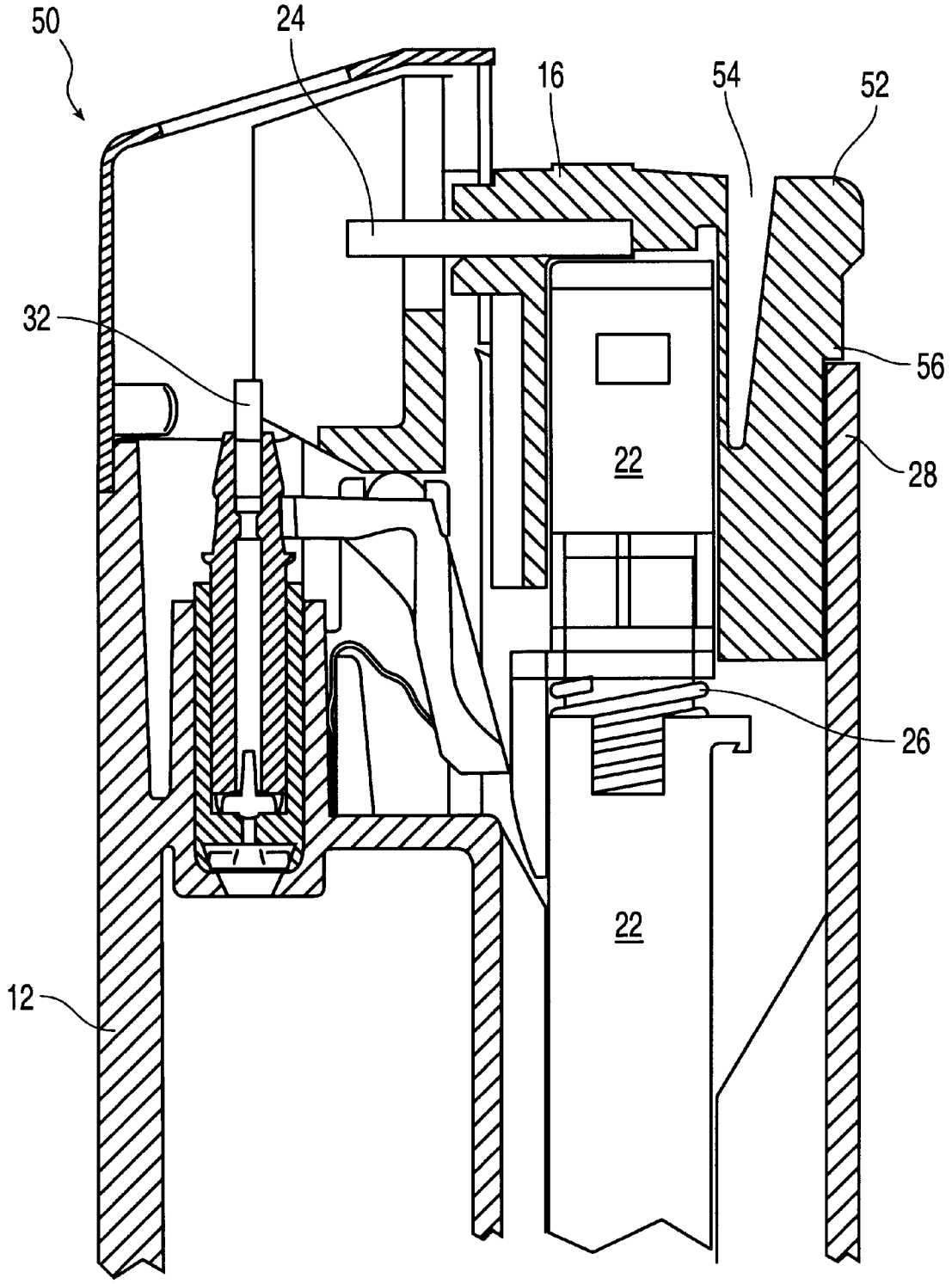
FIG. 6 is a partial cross-sectional view of the lighter depicted in FIG. 4, in a locked position.

It will be apparent from FIGS. 4–6 that an inward force must be applied to the upper end of tab 52 to displace step 56 and prevent it from engaging rear wall 28, thereby allowing actuator 16 to be fully depressed. It will also be apparent to one of ordinary skill in the art that in normal, downward depression of actuator 16, such inward force is not applied.

Figure 7:
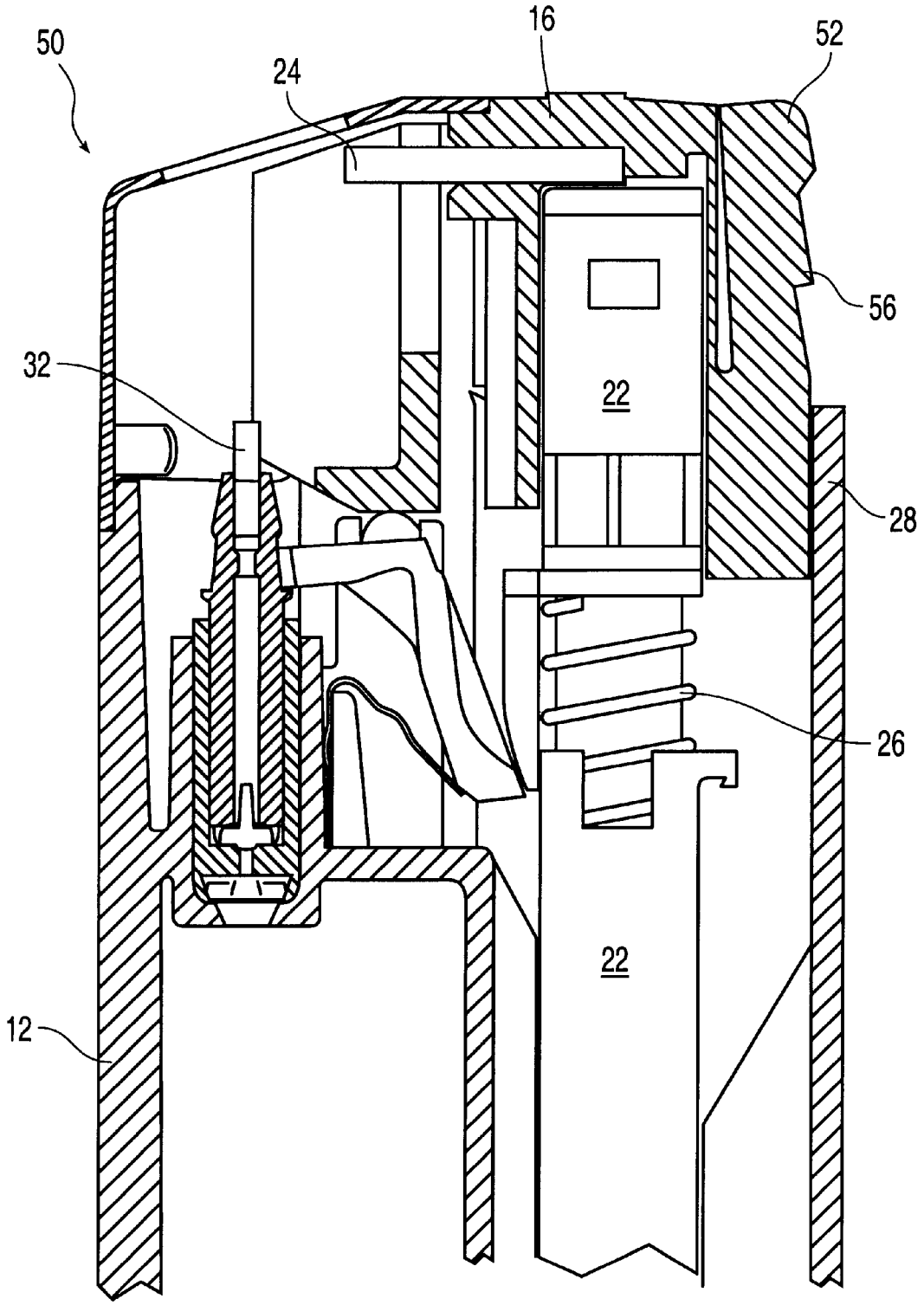
FIG. 7 is a partial cross-sectional view of the lighter depicted in FIG. 4, with the security tab displaced to allow depression of the actuator.

FIG. 7 illustrates lighter 50 with tab 52 displaced inward, to a degree sufficient to enable actuator 16 to be depressed. Advantageously, a user need merely press downward on tab 52 and actuator 16, after forcing tab 52 inward, in order to trigger the ignition system. He or she need not relocate his or her digit to apply the necessary triggering force after thrusting tab 52 inward.

Figure 8:
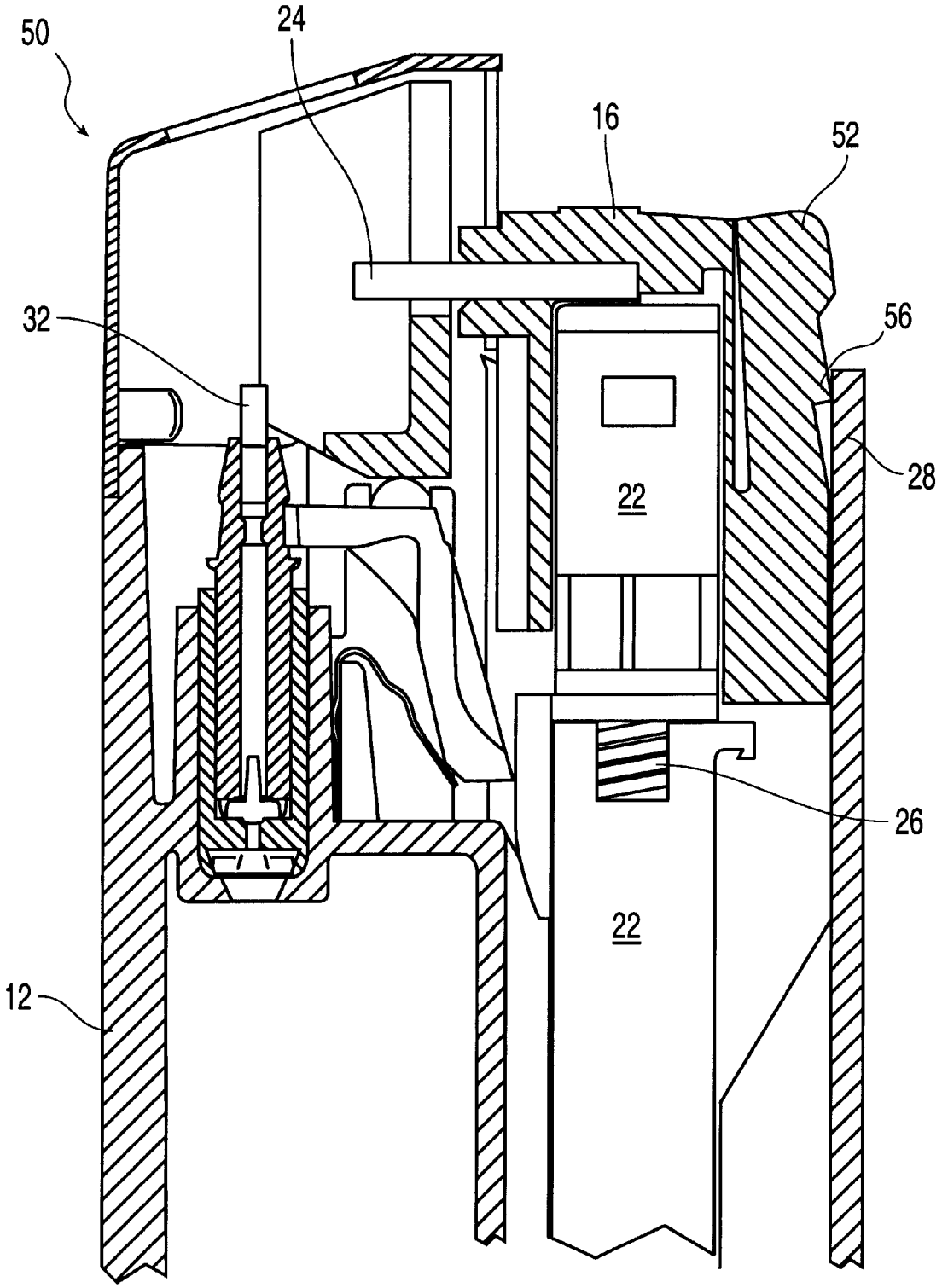
FIG. 8 is a partial cross-sectional view of the lighter depicted in FIG. 4, in an ignition position.

Referring now to FIG. 8, actuator 16 has been depressed far enough to advance step 56 past the upper edge of rear all 28 and activate the ignition system. Spark conductor 24 is lowered in conjunction with actuator 16 and is now in proximity with nozzle 32, thus promoting generation of an ignition spark. The resistance of spring 26 forces actuator 16 to return to its normal position when the downward activation pressure upon actuator 16 is removed, thus restoring tab 52 and step 56 to their blocking positions.

It will be understood by one of skill in the art that actuator 16 and tab 52 are constructed such that tab 52 resists inward pressure. It will also be apparent that the tab could, in another embodiment of the invention, be constructed such that it is connected at its top end to actuator 16. In such an embodiment, depicted in FIGS. 9–11, gap 54 separates the lower end of tab 52 from the actuator. One or more steps 56 are included on tab 52 for the purpose of engaging rear wall 28 when actuator 16 is depressed from its normal position, thus again preventing activation of lighter 50 prior to displacement of tab 52.

Figure 10:
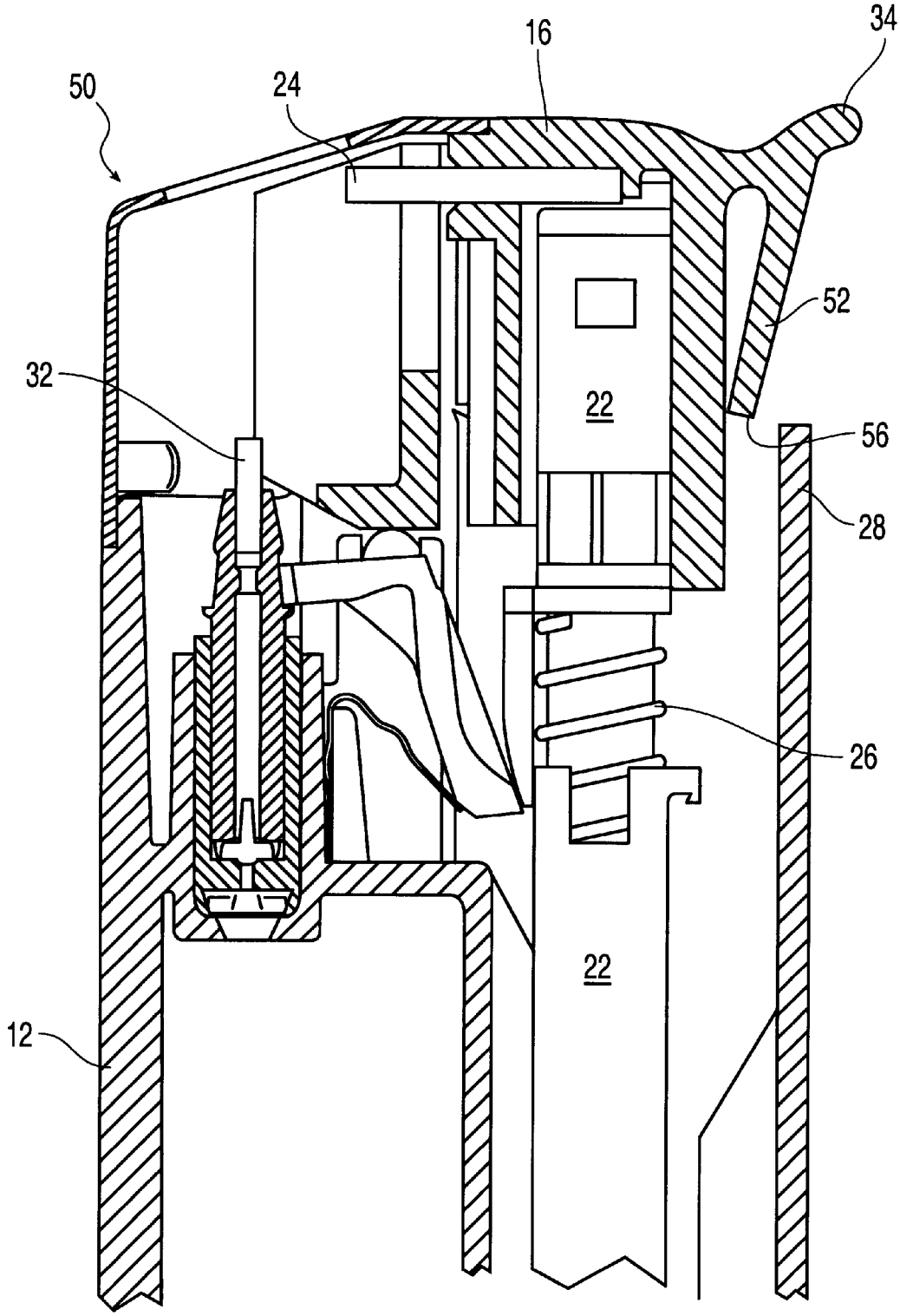
FIG. 10 is a partial cross-sectional view of the lighter depicted in FIG. 9, with the security tab displaced to allow depression of the actuator.

The lower end of tab 52 must be forced inward, as shown in FIG. 10, in order to allow depression of actuator 16 and activation of the ignition system. Additionally, if desired, a separate biasing element, such as spring 58, could be incorporated into gap 54.

Figure 9:
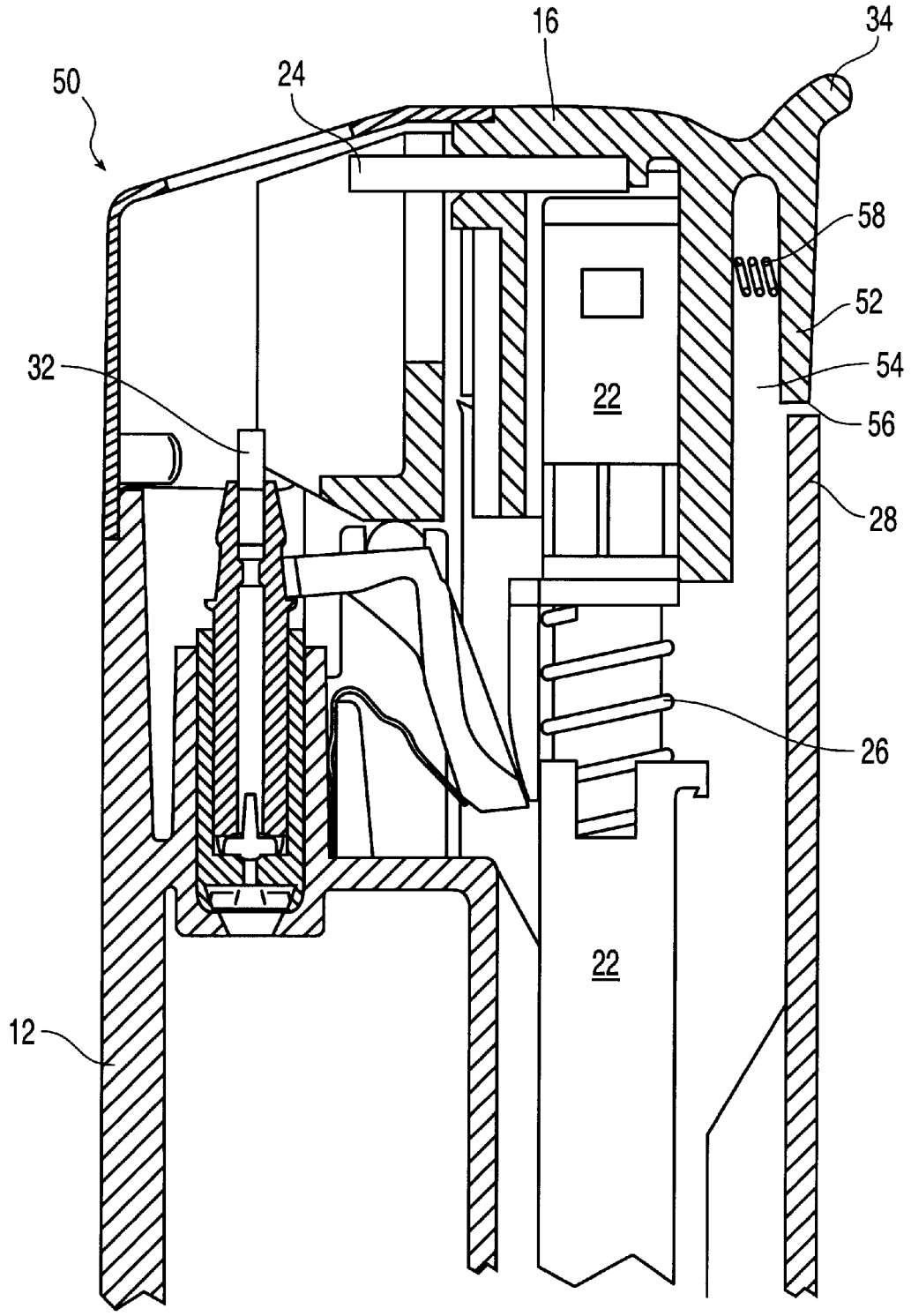
FIG. 9 is a partial cross-sectional view of still another embodiment of the present invention in an idle configuration.
Figure 11:
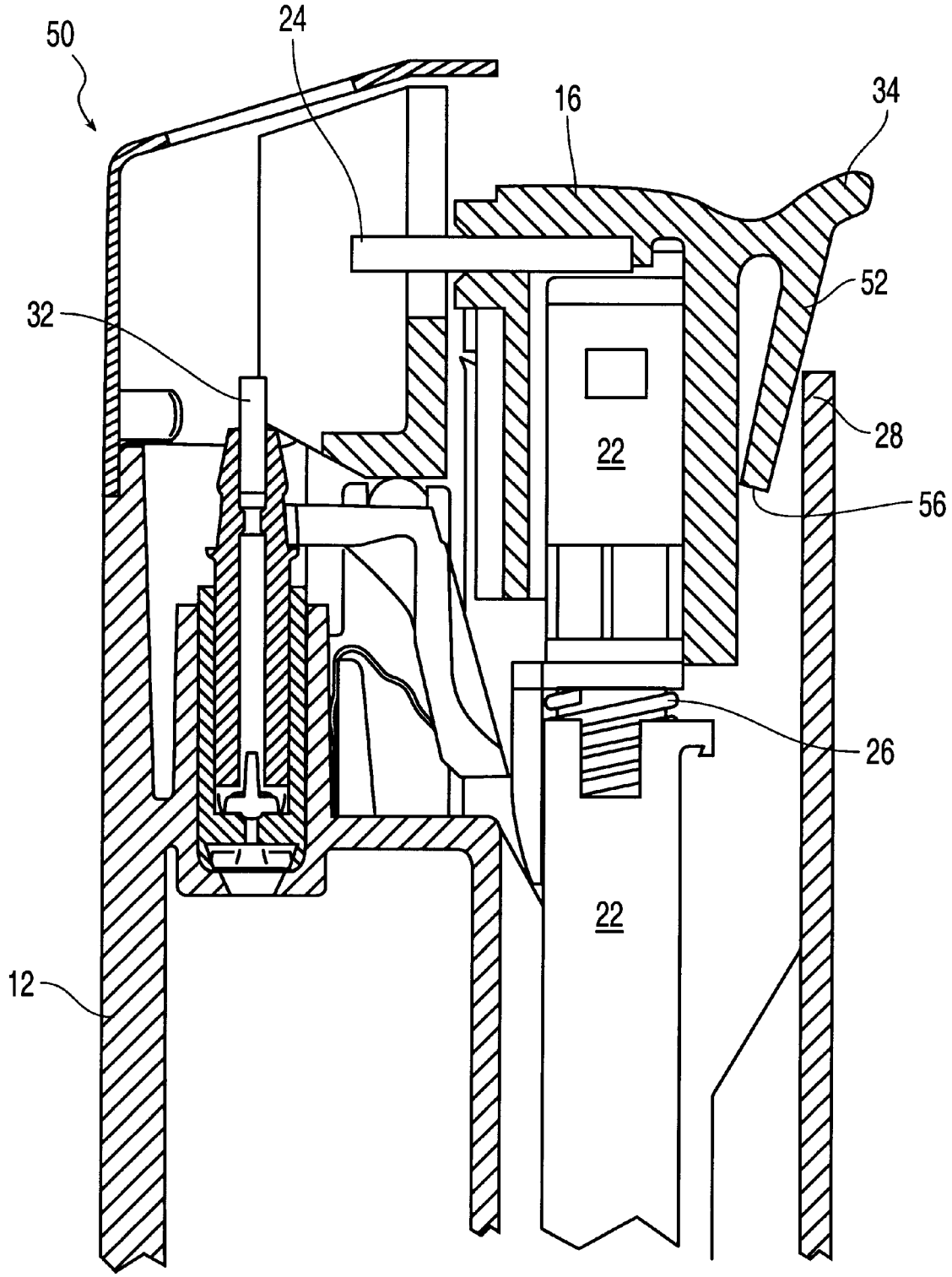
FIG. 11 is a partial cross-sectional view of the lighter depicted in FIG. 9, in an ignition position.

To operate the lighter depicted in FIGS. 9–11, a user first applies a rearward force to ridge 34, thus asserting a lever-like action against tab 52 to move step 56 out of the way of rear wall 28. The user can then depress actuator 16 by applying a downward pressure to ridge 34 and actuator 16. With tab 52 deflected inward, the upper and lower portions of ignition mechanism 22 can be compressed to initiate ignition, as shown in FIG. 11.

Figure 12:
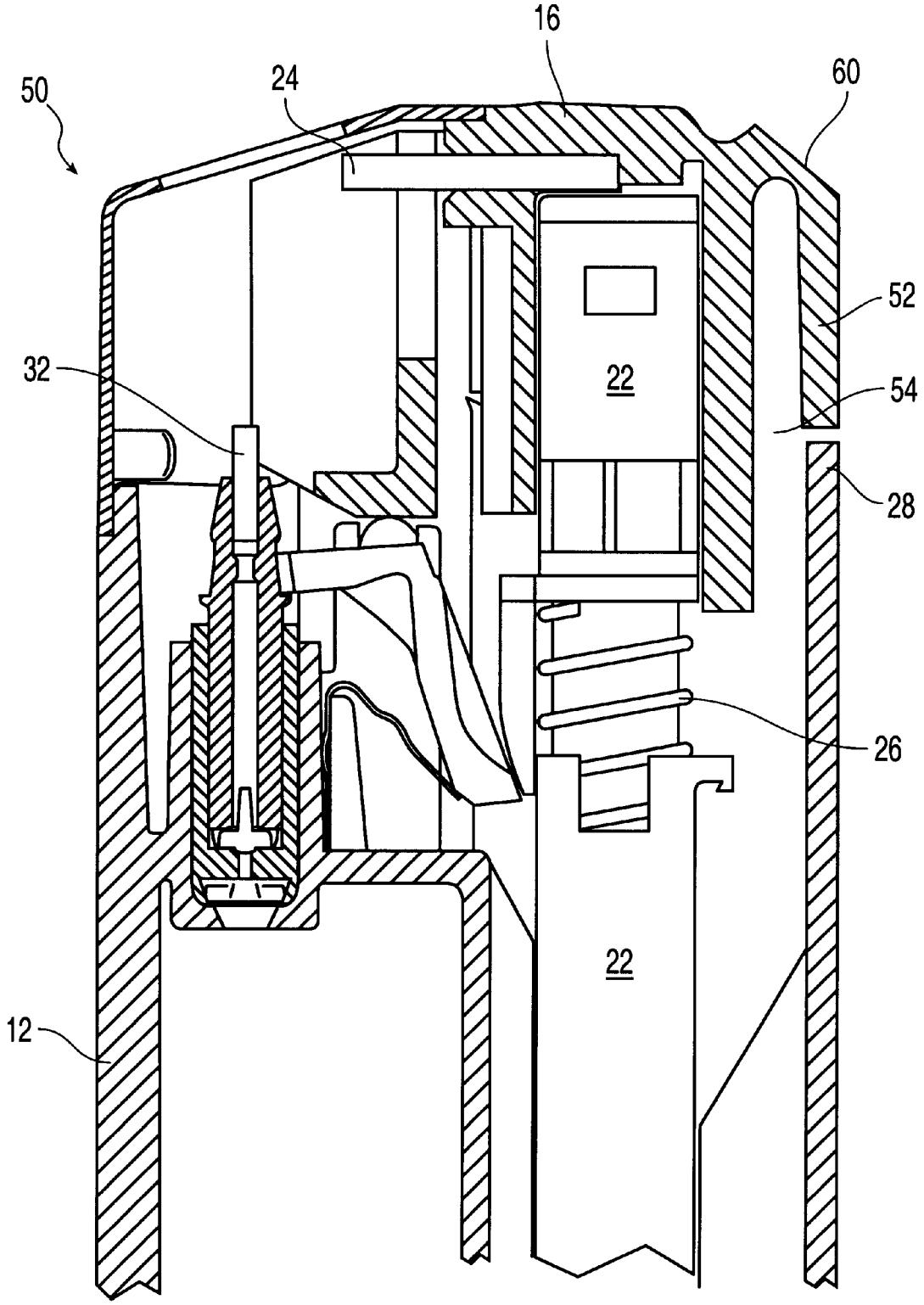
FIG. 12 is a partial cross-sectional view of the lighter depicted in FIG. 9, employing a modified actuator.

As an alternative to the preceding embodiment, ridge 34 may be foregone in favor of an angled plane 60 joining tab 52 and actuator 16. With this option, depicted in FIG. 12, a user applies force similar to that used with ridge 34 in FIG. 11. By pressing inward on the lower portion of plane 60, tab 52 is displaced from its blocking alignment with rear wall 28 to allow depression of actuator 16 and activation of the ignition system.

Various embodiments of the invention have been described. The descriptions are intended to be illustrative, not limitative. Thus, it will be apparent to those skilled in the art that modifications may be made to the invention as described without departing from the scope of the claims set out below.

The ignition system described herein is not limited to use in a lighter. The ignition system can also be employed in other devices that require an enhanced child resistant mechanism, such as piezoelectric ignitions for gas grills, etc.

We claim:

1. A lighter resistant to undesired used, comprising:

an elongated housing having a fuel compartment;

a fuel nozzle in fluid communication with the fuel compartment adapted to selectively release fuel;

an ignition device adapted to ignite the released fuel;

an actuator operatively engaged with said ignition device, such that depression of said actuator from a first elevation to a second elevation actuates said ignition device; and a blocking tab adapted to prevent movement of said actuator from said first elevation to said second elevation, said blocking tab is fixedly connected to the actuator at a top end of the blocking tab and extends therefrom to form a gap at a bottom end with said actuator and said blocking tab is normally positioned in an interfering position, wherein a first blocking part on the blocking tab interferes with a second blocking part on said housing;

wherein a displacement of said blocking tab across said gap to a noninterfering position, wherein said first blocking part does not interfere with said second blocking part, allows said actuator to be depressed from said first elevation to said second elevation.

2. A lighter resistant to undesired used, comprising:

an elongated housing having a fuel compartment;

a fuel nozzle in fluid communication with the fuel compartment adapted to selectively release fuel;

an ignition device adapted to ignite the released fuel;

an actuator operatively engaged with said ignition device, such that depression of said actuator from a first elevation to a second elevation actuates said ignition device; and a blocking tab adapted to prevent movement of said actuator from said first elevation to said second elevation, said blocking tab is fixedly connected to the actuator at a bottom end of the blocking tab and extends therefrom to form a gap with said actuator at a top end of said blocking tab and said blocking tab is normally positioned in an interfering position, wherein a first blocking part on the blocking tab interferes with a second blocking part on said housing;

wherein a displacement of said blocking tab at its top end across said gap to a noninterfering position, wherein said first blocking part does not interfere with said second blocking part, allows said actuator to be depressed from said first elevation to said second elevation.

3. A lighter resistant to undesired used, comprising:

an elongated housing having a fuel compartment;

a fuel nozzle in fluid communication with the fuel compartment adapted to selectively release fuel;

an ignition device adapted to ignite the released fuel;

an actuator operatively engaged with said ignition device, such that depression of said actuator from a first elevation to a second elevation actuates said ignition device; and a blocking tab adapted to prevent movement of said actuator from said first elevation to said second elevation, said blocking tab is fixedly connected to the actuator at a first end of the blocking tab to prevent relative movement between the first end of the blocking tab and the actuator and extends therefrom forming a gap at a distance away from the first end with said actuator; and said blocking tab is normally positioned in an interfering position, wherein a first blocking part on the blocking tab interferes with a second blocking part on said housing;

wherein a displacement of said blocking tab across said gap to a noninterfering position, wherein said first blocking part does not interfere with said second blocking part, allows said actuator to be depressed from said first elevation to said second elevation.

4. The lighter of claim 1 wherein said blocking tab is movable from said interfering position to said noninterfering position by a user applied force and is maintained in said noninterfering position by the user applied force; and wherein said blocking tab automatically returns to said interfering position from said noninterfering position when the user applied force is removed.

5. The lighter as set forth in claim 1 wherein the blocking tab is spaced from the actuator by said gap at a second end.

6. The lighter as set forth in claim 5, wherein the actuator has an outer surface adapted to be contacted by a user and the second end of said blocking tab is spaced from the actuator at the outer surface.

7. The lighter as set forth in claim 6, wherein a resilient member is disposed within said gap to bias the blocking tab to the interfering position.

8. The lighter as set forth in claim 5, wherein the actuator has an outer surface adapted to be contacted by a user and the second end of said block tab is connected to the actuator at the outer surface.

9. The lighter as set forth in claim 8, wherein the block tab includes a ridge, such that when a user-applied force is applied against said ridge the block tab moves across said gap.

10. The lighter as set forth in claim 8, wherein the block tab includes an angled plane, such that when a user-applied force is applied against said angled plane the block tab moves across said gap.

11. The lighter as set forth in claim 8, wherein a resilient member is disposed within said gap to bias the blocking tab to the interfering position.

* * * * *

UNITED STATES PATENT AND TRADEMARK OFFICE

CERTIFICATE OF CORRECTION

PATENT NO. : 6,077,070
DATED : June 20, 2000
INVENTOR(S) : Doucet et al.

It is certified that error appears in the above-identified patent and that said Letters Patent is hereby corrected as shown below:

Column 6,
Lines 4, and 11, delete "1" and insert -- 3 -- in its place.

Signed and Sealed this

Eighteenth Day of September, 2001

*Attest:*

Nicholas P. Godici

*Attesting Officer*

NICHOLAS P. GODICI
*Acting Director of the United States Patent and Trademark Office*